US008118379B2

(12) United States Patent
Hong et al.

(10) Patent No.: US 8,118,379 B2
(45) Date of Patent: Feb. 21, 2012

(54) WASHING MACHINE

(75) Inventors: Seok In Hong, Suwon-Si (KR); Chan Woo Park, Anyang-Si (KR); Woong Sub Yim, Suwon-Si (KR); Jee Won Lee, Seoul (KR); Do Yeon Kim, Seoul (KR); Dong Woo Shin, Suseong-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 372 days.

(21) Appl. No.: 12/382,626

(22) Filed: Mar. 19, 2009

(65) Prior Publication Data

US 2010/0039010 A1 Feb. 18, 2010

(30) Foreign Application Priority Data

Aug. 13, 2008 (KR) ..... 10-2008-0079616

(51) Int. Cl.
*A47B 91/02* (2006.01)

(52) U.S. Cl. ..... 312/351.3; 248/188.3

(58) Field of Classification Search ..... 312/257.1, 312/351.1, 351.3; 248/188, 188.1, 188.2, 248/188.3, 188.4, 188.8, 188.9, 649, 650
See application file for complete search history.

(56) References Cited

U.S. PATENT DOCUMENTS

| | | | | | |
|---|---|---|---|---|---|
| 1,245,243 | A * | 11/1917 | Lapham | 248/616 |
| 2,055,715 | A * | 9/1936 | Barker | 248/188.3 |
| 2,243,565 | A * | 5/1941 | Kimball et al. | 210/365 |
| 2,852,883 | A * | 9/1958 | Walsh | 248/188.9 |
| 5,156,451 | A * | 10/1992 | Pollock | 312/351.3 |
| 5,332,182 | A * | 7/1994 | Weisz et al. | 248/188.4 |
| 5,344,116 | A * | 9/1994 | Winkler | 248/677 |
| 7,717,380 | B2 * | 5/2010 | Kwon et al. | 248/188.3 |
| 7,744,050 | B2 * | 6/2010 | de Toledo et al. | 248/188.3 |
| 2005/0116134 | A1 * | 6/2005 | Lee et al. | 248/650 |
| 2005/0279895 | A1 * | 12/2005 | Lee et al. | 248/188.8 |
| 2007/0023591 | A1 * | 2/2007 | Kwon et al. | 248/188.3 |

FOREIGN PATENT DOCUMENTS

JP 10-2005-0051476 6/2005

* cited by examiner

*Primary Examiner* — James O Hansen
(74) *Attorney, Agent, or Firm* — Staas & Halsey LLP

(57) ABSTRACT

Disclosed is a support apparatus for a washing machine. The support apparatus includes a first adjustment unit coupled to a base, in which a coupling position of the first adjustment unit to the base is adjustable, and a second adjustment unit that is movable relative to the first adjustment unit.

9 Claims, 5 Drawing Sheets

WASHING MACHINE

CROSS-REFERENCE TO RELATED APPLICATIONS

This application claims the benefit of Korean Utility Model Application No. 10-2008-0079616 filed on Aug. 13, 2008, in the Korean Intellectual Property Office, the disclosure of which is incorporated herein by reference.

BACKGROUND

1. Field

The present invention relates to a support apparatus for a washing machine. More particularly, the present invention relates to a support apparatus for a washing machine, which can be easily exchanged and height of which can be automatically adjusted.

2. Description of the Related Art

In general, a washing machine is classified into a pulsator type washing machine or a drum type washing machine. As a pulsator or a drum rotates, vibration is generated in the washing machine, so that noise is generated. In particular, if the washing machine is unstably installed on the ground, much vibration and noise may occur when the pulsator or the drum rotates.

Legs are installed at the bottom of the washing machine. The legs support the washing machine in a state in which the washing machine is spaced apart from the floor or the ground. In order to minimize the vibration and noise of the washing machine, the legs must be stably secured on the ground.

However, since the ground may have an irregular surface, at least one of the legs may be spaced apart from the ground when the washing machine is installed on the ground. If the washing machine is unstably installed as described above, the washing machine may be severely vibrated while the washing cycle is being performed, thereby generating loud noise.

In order to solve the above problem, the legs are designed such that height of the legs can be adjusted. That is, the legs are screw-coupled to a base of the washing machine in such a manner that the user can adjust the height of the legs by rotating the legs. In this case, the user or the worker can securely install the legs on the ground by rotating the legs even if at least one of the legs is spaced apart from the ground.

SUMMARY

Accordingly, it is an aspect of the present invention to provide a support apparatus for a washing machine, capable of adjusting height of the washing machine and having a damping function to reduce vibration of the washing machine.

Additional aspects and/or advantages of the invention will be set forth in part in the description which follows and, in part, will be apparent from the description, or may be learned by practice of the invention.

The foregoing and/or other aspects of the present invention are achieved by providing a washing machine including a cabinet having a base, and a support apparatus to support the cabinet, wherein the support apparatus includes a first adjustment unit coupled to the base, in which a coupling position of the first adjustment unit relative to the base is adjustable, and a second adjustment unit that is movable relative to the first adjustment unit.

The first adjustment unit includes a guide member guiding the second adjustment unit. The second adjustment unit includes a foot member that slidably moves along the guide member, and a spring member that presses the foot member. The guide member has a first stopper and the foot member has a second stopper installed above the first stopper. The first stopper protrudes from an inner surface of the guide member and the second stopper protrudes from an outer surface of the foot member. The foot member includes a rubber member that makes contact with the ground. The second adjustment unit moves up and down in the first adjustment unit.

The washing machine further includes a friction member installed on one of the first and second adjustment units to make friction relative to another one of the first and second adjustment units.

The friction member includes felt material. The first adjustment unit includes a coupling member that is screw-coupled with the base. The coupling member has a male screw member and the base has a mount member formed with a female screw member corresponding to the male screw member.

The foregoing and/or other aspects of the present invention are achieved by providing a washing machine including a base defining a perforation hole formed in a longitudinal direction of the base, a coupling member coupled with the base and passing through the perforation hole, and a foot member elastically supported between the coupling member and a ground to move relative to the coupling member.

The base includes a mount member coupled with the coupling member. The mount member is screw-coupled with the coupling member. The washing machine further includes a guide member disposed between the coupling member and the foot member to guide the foot member. The washing machine further includes a friction member disposed between the guide member and the foot member.

As described above, according to the support apparatus for the washing machine of the present invention, the height of the support apparatus can be manually or automatically adjusted, so that the washing machine can be stably installed on the ground, thereby reducing vibration.

In addition, the support apparatus according to the present invention can be easily assembled with the washing machine and the user can easily exchange the support apparatus when the support apparatus is broken, so that usefulness of the washing machine can be improved.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
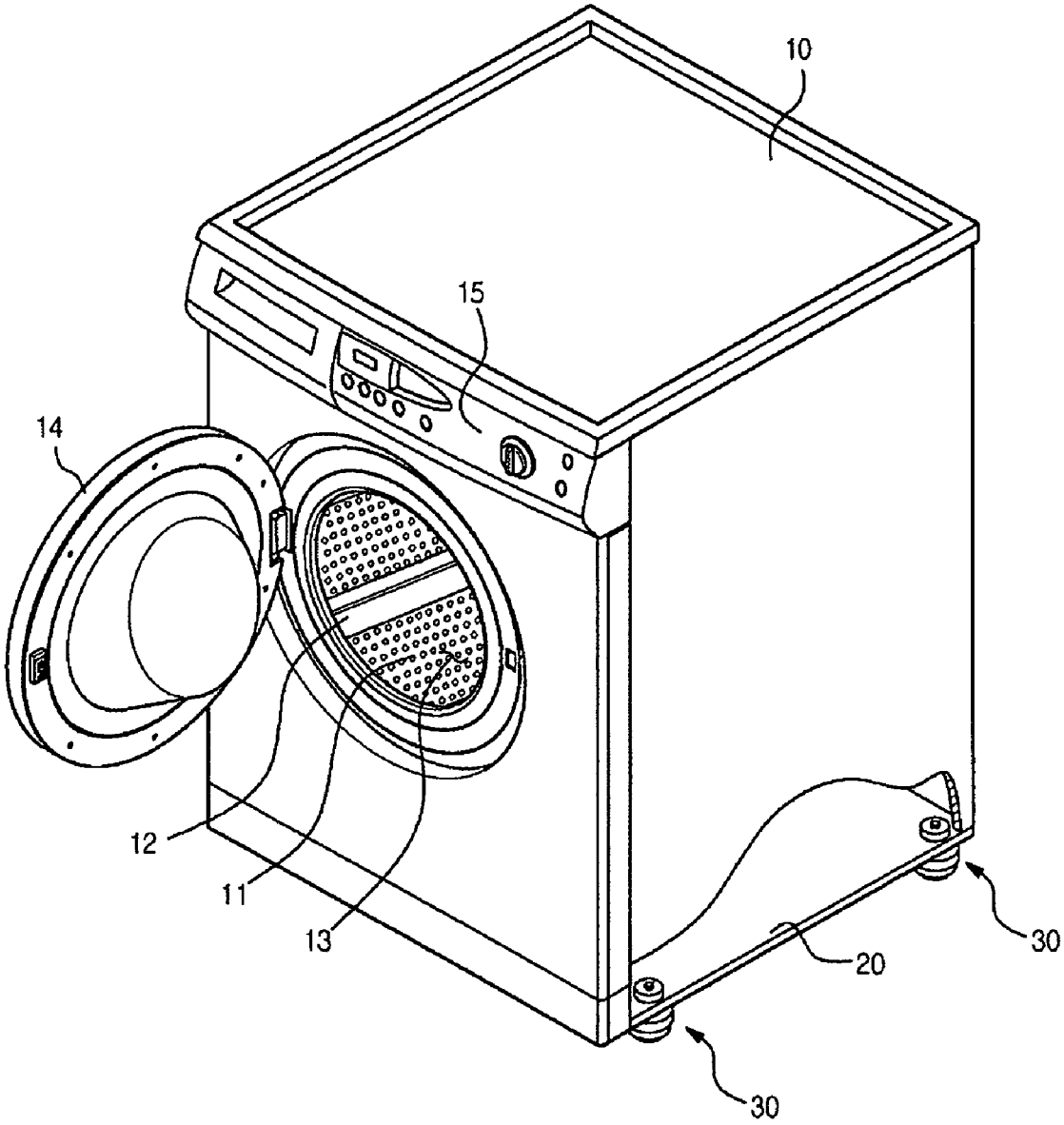
FIG. 1 is a perspective view showing a washing machine installed on the ground according to an embodiment of the present invention.

Reference will now be made in detail to the embodiments of the present invention, examples of which are illustrated in the accompanying drawings, wherein like reference numerals refer to the like elements. The embodiments are described below to explain the present invention by referring to the figures.

FIG. 1 is a perspective view showing a washing machine installed on the ground according to an embodiment of the present invention.

As shown in FIG. 1, the washing machine according to the embodiment of the present invention includes a cabinet 10, a water reservoir (not shown) installed in the cabinet 10, and a drum 11 installed in the water reservoir. A lifter 12 is provided at an inner wall of the drum 11 in order to lift up and then drop down laundry while the drum 11 is rotating.

The cabinet 10 has a substantially hexahedral structure. The cabinet 10 is formed at the front center thereof with an opening 13 to allow the user to put laundry in the drum 11 or to take out the laundry from the drum 11, and a door 14 is rotatably installed around the opening 13 to open or close the opening 13. A control panel 15 is installed at a front upper portion of the cabinet 10 to notify the user of the operational state of the washing machine or to allow the user to control the operation of the washing machine. A plurality of support apparatuses 30 are installed along a peripheral portion of the bottom of a base 20 provided at a lower portion of the cabinet 10.

The support apparatuses 30 are securely installed on the ground to stably support the washing machine. If the washing machine is unstably installed because at least one of the support apparatuses 30 is not securely installed on the ground, loud vibration and noise may occur while the drum 11 of the washing machine is rotating. To solve this problem, the support apparatuses 30 have damping functions to reduce vibration and noise and height of the support apparatuses 30 is adjustable such that the support apparatuses 30 can be stably secured to the ground.

Figure 2:
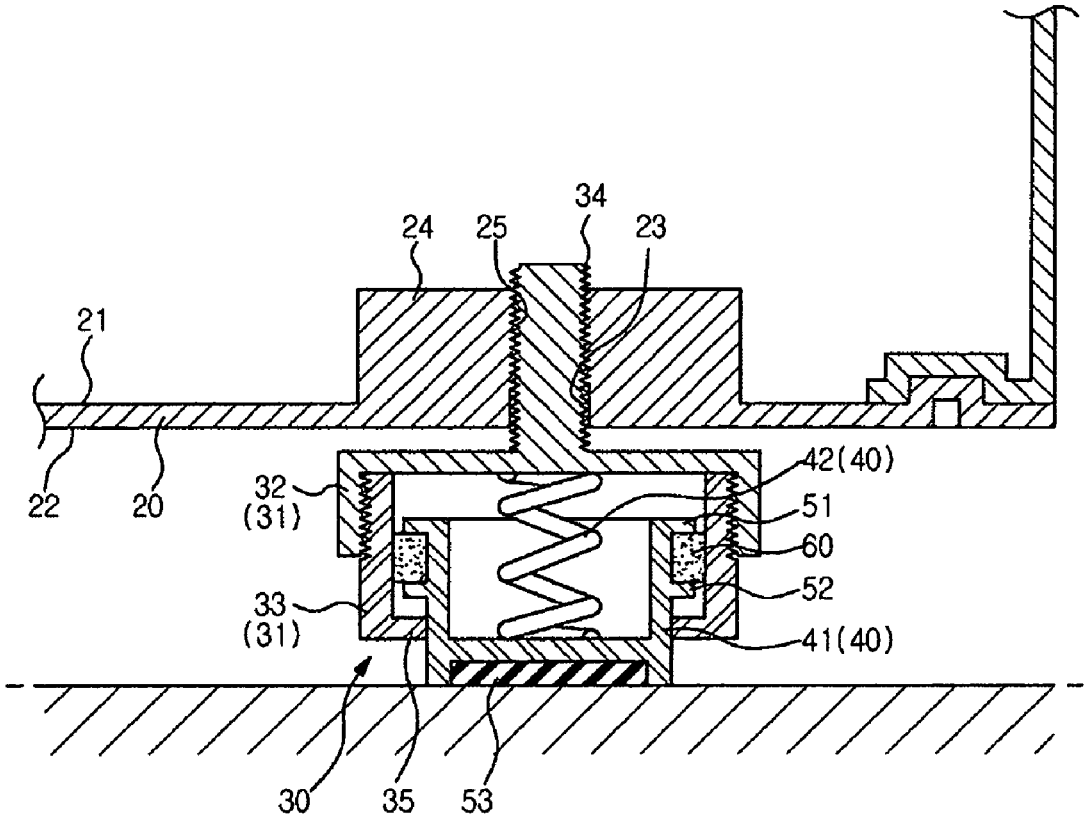
FIG. 2 is a sectional view showing a support apparatus installed on a base according to an embodiment of the present invention.
Figure 3:
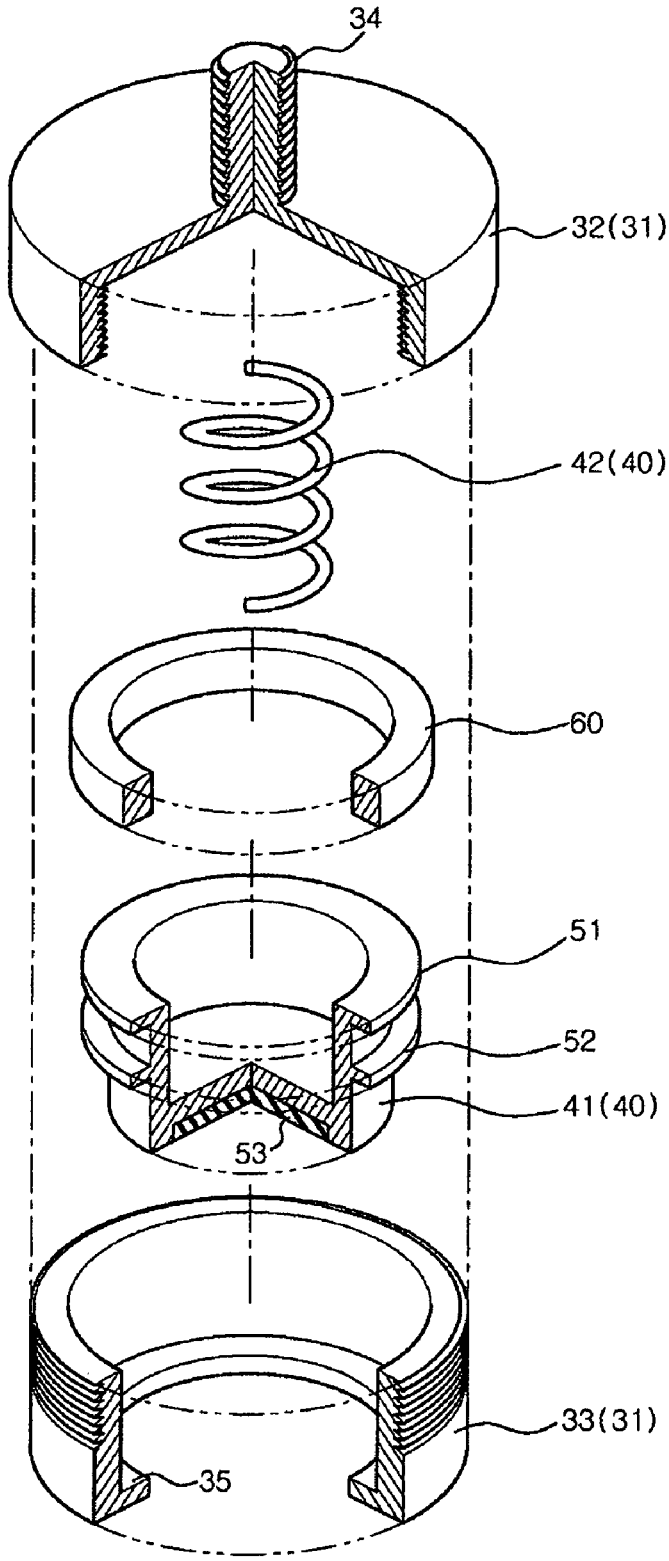
FIG. 3 is an exploded perspective view showing a support apparatus according to an embodiment of the present invention.

FIG. 2 is a sectional view showing the support apparatus installed on the base according to an embodiment of the present invention, and FIG. 3 is an exploded perspective view showing the support apparatus according to an embodiment of the present invention.

As shown in FIGS. 2 and 3, the support apparatus 30 according to an embodiment of the present invention includes a first adjustment unit 31 installed on the base 20, and a second adjustment unit 40 coupled to the first adjustment unit 31. The first adjustment unit 31 has a coupling member 32 coupled to the base 20 at an upper portion of the first adjustment unit 31, and a guide member 33 guiding the second adjustment unit 40 at a lower portion of the first adjustment unit 31.

The coupling member 32 has a cylindrical structure, in which an upper portion thereof is closed and a lower portion thereof is open. The coupling member 32 is screw-coupled to the base 20 by a male screw member 34 protruding upward from the coupling member 32.

The base 20 has a mount member 24 coupled with the coupling member 32. The mount member 24 is provided on one of a top surface 21 or a bottom surface 22 of the base 20 corresponding to a perforation hole 23 of the base 20. In FIG. 2, the mount member 24 is integrally formed with the top surface of the base 20. The mount member 24 is formed with a female screw member 25 into which the male screw member 34 is screw-coupled. As the male screw member 34 is screw-coupled into the female screw member 25, the coupling member 32 of the first adjustment unit 31 is coupled with the mount member 24 of the base 20.

Due to the above coupling structure, the coupling member 32 can move up and down along the base 20. That is, since the male screw member 34 is screw-coupled with the female screw member 25, if the user or the worker rotates the coupling member 32 in the forward direction or the reverse direction, the coupling member 32 moves up or down. Thus, the user can manually adjust the height of the support apparatus 30. This will be described later in detail.

The guide member 33 has a cylindrical structure. A radius of the guide member 33 having the cylindrical structure is smaller than a radius of the coupling member 32, so that the upper portion of the guide member 33 can be inserted into the lower portion of the coupling member 32. That is, the outer portion of the guide member 33 is screw-coupled into the inner portion of the coupling member 32.

The second adjustment unit 40 includes a foot member 41 inserted into the guide member 33, and a spring member 42 elastically pressing the foot member 41 in the downward direction. The foot member 41 has a cylindrical structure, in which an upper portion thereof is open and a lower portion thereof is closed. Since a radius of the foot member 41 having the cylindrical structure is smaller than a radius of the guide member 33, the foot member 41 can be inserted into the guide member 33 such that the foot member 41 can move up and down along the guide member 33. A first stopper 35 protrudes from an inner lower portion of the guide member 33 and a second stopper 52 protrudes from an outer upper portion of the foot member 41 to prevent the foot member 41 from being separated from the guide member 33. When the foot member 41 moves down along the guide member 33, the second stopper 52 makes contact with the first stopper 35 so that the foot member 41 can be prevented from being separated from the guide member 33.

A rubber member 53 is provided at an underside of the foot member 41. The rubber member 53 increases friction relative to the ground, thereby preventing the foot member 41 from sliding on the ground. As shown in FIG. 2, when the foot member 41 supports the support apparatus 30 on the ground, the support apparatus 30 is prevented from sliding on the ground due to the rubber member 53.

The spring member 42 is installed between the coupling member 32 and the foot member 41. An upper portion of the spring member 42 is supported on the coupling member 32 and a lower portion of the spring member 42 is supported on the foot member 41. The spring member 42 includes a compression coil spring. Such a spring member 42 applies elastic force to the coupling member 32 and the foot member 41 in the opposite direction. In particular, the spring member 42 pushes down the foot member 41 such that the foot member 41 can be securely placed on the ground. Due to the above action of the spring member 42, the height of the support apparatus 30 can be automatically adjusted, which will be described later in detail.

As described above, the support apparatus 30 has the damping function. In order to realize the damping function, the support apparatus 30 includes a friction member 60 installed between the outer surface of the foot member 41 and the inner surface of the guide member 33. As shown in FIG. 2, the friction member 60 is installed on the outer surface of the foot member 41, so that friction may occur between the friction member 60 and the guide member 33 as the foot member 41 moves up and down. That is, when the washing machine is vibrated, the foot member 41 moves relative to the guide member 33. At this time, since the friction member 60 is provided between the guide member 33 and the foot member 41, the relative movement between the guide member 33 and the foot member 41 can be reduced. In other words, the friction member 60 generates friction between the guide member 33 and the foot member 41 to provide the support apparatus 30 with the damping function. In addition, although not shown in the drawings, the friction member 60 can be installed on the guide member 33. In this case, friction may occur between the friction member 60 and the foot member 41 as the foot member 41 moves up and down. Since frictional heat is transferred to the friction member 60 due to the friction between the friction member 60 and the foot member 41 (or the guide member 33), the friction member must include material having superior durability. The friction member 60 may include felt material having superior durability and heat-resistant characteristics.

Referring to FIG. 2, first and second seat protrusions 51 and 52 are formed in the foot member 41 to install the friction member 60 therebetween. The first and second seat protrusions 51 and 52 protrude from the outer surface of the foot member 41. The second stopper 52 may serve as the second protrusion 52. In addition, although not shown in the drawings, a groove having a predetermined depth can be formed in the foot member 41 or the guide member 33 to accommodate the friction member 60 in the groove.

Hereinafter, a method of assembling the support apparatus 30 and a method of coupling the support apparatus 30 to the washing machine will be described.

As shown in FIG. 3, the foot member 41 is inserted into the guide member 33 in a state in which the friction member 60 is fitted between the first and second seat protrusions 51 and 52. If the second stopper 52 of the foot member 41 makes contact with the first stopper 35 of the guide member 33, the foot member 41 is completely inserted into the guide member 33. Then, the spring member 42 is installed in the foot member 41. That is, the foot member 41 is installed in the guide member 33, and the spring member 42 is installed in the foot member 41. After that, the guide member 33 is coupled with the coupling member 32. At this time, the guide member 33 is screw-coupled into the coupling member 32, so that the coupling member 32 and the foot member 41 press the spring member 42. That is, one end of the spring member 42 is supported on the coupling member 32 and the other end of the spring member 42 is supported on the foot member 41, so that the assembling process for the support apparatus 30 is completed.

As shown in FIG. 2, in the washing machine according to an embodiment of the present invention, the male screw member 34 is screw-coupled into the female screw member 25 from the lower portion of the perforation hole 23. Thus, the coupling member 32 is coupled with the mount member 24. Due to the above coupling structure, the support apparatus 30 can be easily coupled to the base 20. Thus, according to the washing machine of the embodiment of the present invention, the user or the worker is not needed to install the support apparatus 30 to the base 20 of the washing machine in the internal space S of the washing machine. In other words, the user or the worker can easily assemble/disassemble the support apparatus 30 to the base 20 of the washing machine from the outside of the washing machine. Thus, when the support apparatus 30 is broken or defective, the user or the worker can easily exchange the support apparatus 30 with new one. This may maximize usefulness of the washing machine and improve user's satisfaction for the washing machine.

According to an embodiment of the present invention, the coupling structure between the foot member 41 and the first adjustment unit 31 modified such that the foot member 41 can move relative to the first adjustment unit 31, so the support apparatus 30 has the damping function and the height of the support apparatus 30 can be automatically adjusted. According to the related art, the first adjustment unit 31 is integrally formed with the foot member 41, so that the first adjustment unit 31 moves together with the foot member 41. Thus, the first adjustment unit 31 must move relative to the base 20 in order to provide the support apparatus 30 with the automatic height adjustment and damping functions. That is, according to the related art, an additional device is necessary to allow the first adjustment unit 31 to move relative to the base 20, so that the user or the worker must fix the first adjustment unit 31 to the base 20 together with the additional device in the internal space S of the washing machine. However, according to an embodiment of the present invention, as shown in FIG. 2, the foot member 41 can move relative to the first adjustment unit 31, so that the user or the worker can fix the first adjustment unit 31 to the base 20 of the washing machine from the outside of the washing machine.

Figure 4:
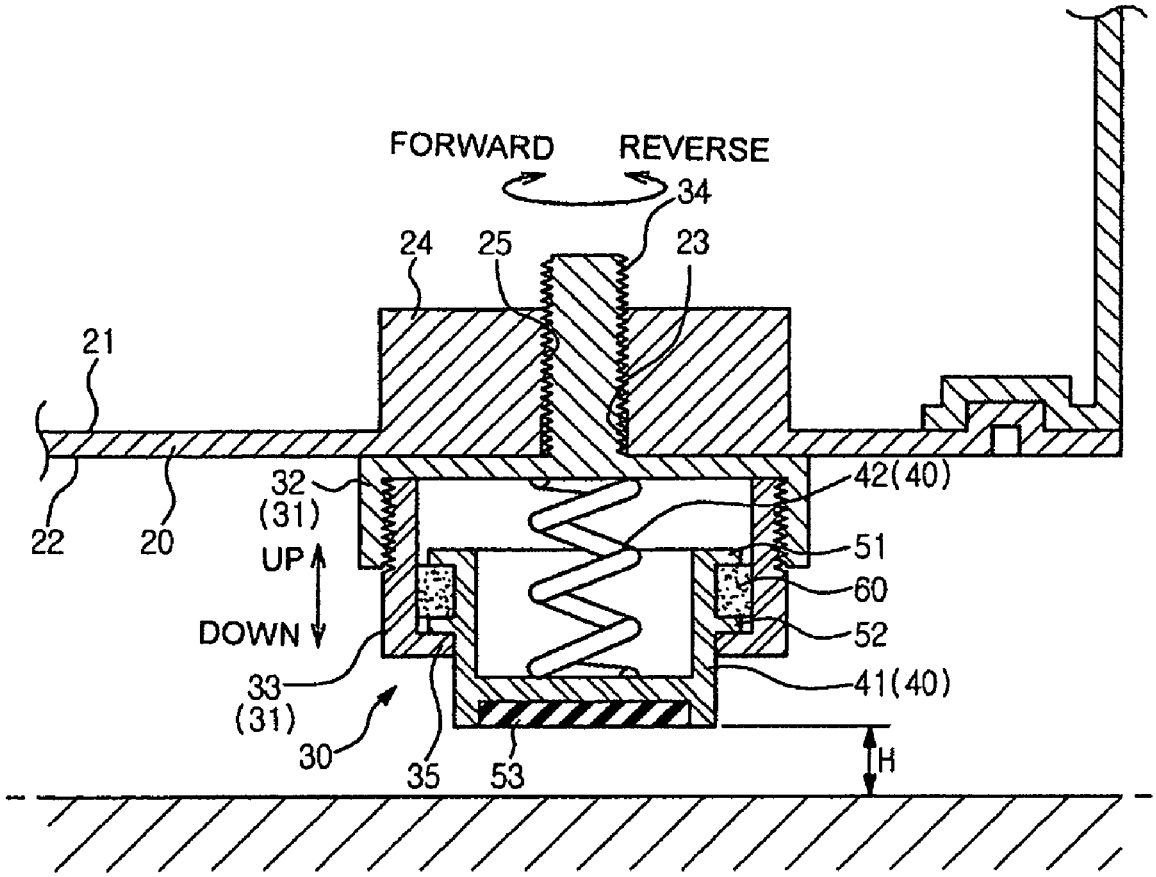
FIG. 4 is a sectional view showing a support apparatus, which is being manually adjusted, according to an embodiment of the present invention.

FIG. 4 is a sectional view showing the support apparatus, which is being manually adjusted, according to an embodiment of the present invention.

As shown in FIGS. 1, 2 and 4, when installing the washing machine according to the present invention such that the washing machine is spaced apart from the ground, the support apparatuses 30 are coupled to the base 20. At this time, as shown in FIG. 4, if one of the support apparatuses 30 is spaced apart from the ground by predetermined height H, the user or the worker manually adjusts the support apparatus 30 such that the support apparatus 30 can be secured to the ground. That is, if the user or the worker rotates the first adjustment unit 31 of the support apparatus 30 in the forward direction or the reverse direction, the first adjustment unit 31 moves up or down. As the first adjustment unit 31 moves up or down, a gap between the first adjustment unit 31 and the base 20 may become enlarged or reduced. That is, the fixing position of the first adjustment unit 31 to the base 20 is changed. Therefore, if the support apparatus 30 is spaced apart from the ground as shown in FIG. 4, the user or the worker manually rotates the first adjustment unit 31 in the reverse direction. In this case, the first adjustment unit 31 is moved down, so that the support apparatus 30 can be secured to the ground. At this time, the fixing position of the first adjustment unit 31 to the base 20 is shifted upward.

Figure 5:
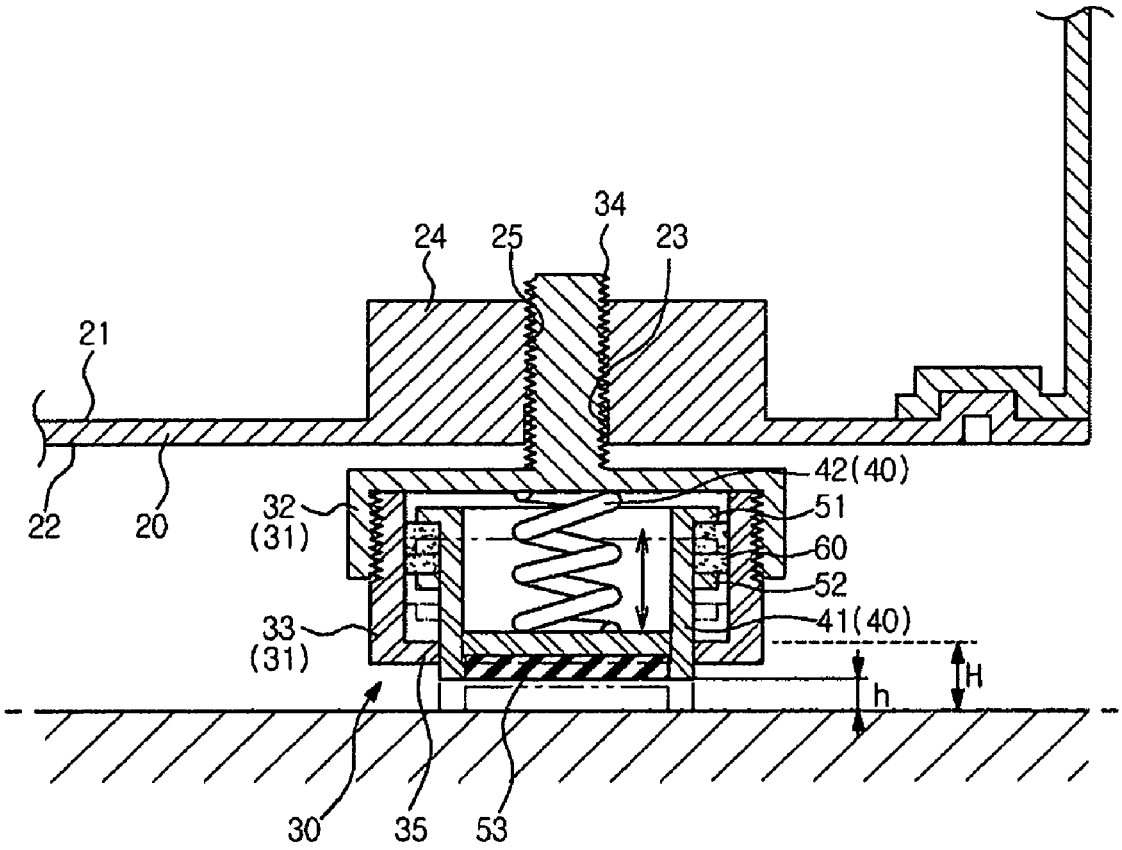
FIG. 5 is a sectional view showing a support apparatus, which is being automatically adjusted, according to an embodiment of the present invention.

FIG. 5 is a sectional view showing the support apparatus, which is being automatically adjusted, according to an embodiment of the present invention.

As shown in FIG. 5, in the support apparatus 30 according to an embodiment of the present invention, the spring member 42 presses the foot member 41 toward the ground. Thus, if the foot member 41 is spaced apart from the ground by small height h, the foot member 41 can be secured to the ground due to the pressing force of the spring member 42 applied to the foot member 41. That is, the height of the support apparatus 30 is automatically adjusted even if the user or the worker does not additionally adjust the height of the support apparatus 30.

If the foot member 41 is spaced apart from the ground by predetermined height H, the foot member 41 may not be secured to the ground even if the spring member 42 applies the pressing force to the foot member 41. In this case, as shown in FIG. 4, the user or the worker manually rotates the first adjustment unit 31 in the forward direction or the reverse direction to secure the foot member to the ground.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet having a base; and a support apparatus to support the cabinet, wherein the support apparatus comprises:

a first adjustment unit coupled to the base, in which a coupling position of the first adjustment unit to the base is adjustable; and a second adjustment unit that is movable relative to the first adjustment unit, wherein the first adjustment unit comprises a guide member to guide the second adjustment unit and a coupling member that is screw-coupled with the base, wherein an outer portion of the guide member is screw-coupled into an inner portion of the coupling member, and wherein the second adjustment unit comprises a foot member that slidably moves along the guide member, and a spring member that presses the foot member.

2. The washing machine as claimed in claim 1, wherein the guide member has a first stopper and the foot member has a second stopper installed above the first stopper.

3. The washing machine as claimed in claim 2, wherein the first stopper protrudes from an inner surface of the guide member and the second stopper protrudes from an outer surface of the foot member.

4. The washing machine as claimed in claim 1, wherein the foot member comprises a rubber member that makes contact with a ground.

5. The washing machine as claimed in claim 1, wherein the second adjustment unit moves up and down in the first adjustment unit.

6. The washing machine as claimed in claim 1, further comprising a friction member installed on any one of the first and second adjustment units to create friction relative to another of the first and second adjustment units.

7. The washing machine as claimed in claim 6, wherein the friction member includes a felt material.

8. A washing machine comprising:

a base defining a perforation hole formed in a longitudinal direction of the base;

a coupling member coupled with the base and passing through the perforation hole;

a foot member elastically supported between the coupling member and a ground to move relative to the coupling member; and a guide member disposed between the coupling member and the foot member to guide the foot member, wherein an outer portion of the guide member is screw-coupled into an inner portion of the coupling member, wherein the base comprises a mount member coupled with the coupling member, and wherein the mount member is screw-coupled with the coupling member.

9. A washing machine comprising:

a cabinet having a base; and a support apparatus to support the cabinet, wherein the support apparatus comprises:

a first adjustment unit coupled to the base, in which a coupling position of the first adjustment unit to the base is adjustable;

a second adjustment unit that is movable relative to the first adjustment unit, and a friction member installed on any one of the first and second adjustment units to create friction relative to another of the first and second adjustment units, wherein the first adjustment unit comprises a guide member to guide the second adjustment unit and a coupling member that is screw-coupled with the base, wherein an outer portion of the guide member is screw-coupled into an inner portion of the coupling member, and wherein the second adjustment unit comprises a foot member that slidably moves along the guide member; first and second seat protrusions protrude from the outer surface of the foot member; and the friction member is installed between the first and second seat protrusions.

* * * * *